US007134162B2

(12) United States Patent
Kweon et al.

(10) Patent No.: US 7,134,162 B2
(45) Date of Patent: Nov. 14, 2006

(54) TOOTHBRUSH HAVING SOFT AND HARD BRISTLES TOGETHER

(75) Inventors: Young Jun Kweon, 201-7, Heukseok 1-dong Dongjak-gu, Seoul 156-861 (KR); Sung Wook Kwon, 201-7, Heukseok 1-dong Dongjak-gu, Seoul 156-861 (KR)

(73) Assignees: CJ Corp. (KR); Young Jun Kweon (KR); Sung Wook Kwon (KR)

( * ) Notice: Subject to any disclaimer, the term of this patent is extended or adjusted under 35 U.S.C. 154(b) by 230 days.

(21) Appl. No.: 10/443,280

(22) Filed: May 22, 2003

(65) Prior Publication Data

US 2004/0083569 A1 May 6, 2004

(30) Foreign Application Priority Data

Oct. 31, 2002 (KR) ..... 10-2002-0066977

(51) Int. Cl.
*A46B 9/04* (2006.01)

(52) U.S. Cl. ..... 15/167.1; 15/207.2; 15/DIG. 5

(58) Field of Classification Search ..... 15/167.1, 15/207.2, DIG. 5
See application file for complete search history.

(56) References Cited

U.S. PATENT DOCUMENTS

| | | | | |
|---|---|---|---|---|
| 74,560 | A * | 2/1868 | Maury | 15/167.1 |
| 1,705,542 | A * | 3/1929 | Ryser | 15/145 |
| 2,097,987 | A * | 11/1937 | Charles | 15/167.1 |
| 5,305,489 | A * | 4/1994 | Lage | 15/167.1 |
| 5,398,367 | A * | 3/1995 | Lu | 15/167.1 |
| 5,533,227 | A * | 7/1996 | Ito et al. | 15/167.1 |
| 5,655,249 | A * | 8/1997 | Li | 15/167.1 |
| 5,974,619 | A * | 11/1999 | Weihrauch | 15/186 |
| 6,021,541 | A * | 2/2000 | Mori et al. | 15/167.1 |
| 6,090,488 | A * | 7/2000 | Kweon | 428/399 |
| 6,108,849 | A * | 8/2000 | Weihrauch | 15/167.1 |
| 6,564,416 | B1 | 5/2003 | Claire et al. | |
| 2002/0116778 | A1 * | 8/2002 | Kwon | 15/167.1 |

FOREIGN PATENT DOCUMENTS

WO WO 03/032772 A1 4/2003

* cited by examiner

*Primary Examiner*—Randall Chin
(74) *Attorney, Agent, or Firm*—Swanson & Bratschun, LLC

(57) ABSTRACT

Disclosed is a toothbrush having soft and hard bristles together. The toothbrush having soft and hard bristles with 6–10 mm in tapered length and 0.01–0.08 mm in diameter of end portions comprises: longer bristles(1) located at both edges; and shorter bristles(2) located at the central portion, wherein the bristles are generally in a semicircular form at their top portions when seen from a side, and a difference in length between the longer bristles(1) and the shorter bristles (2) is about 2–4 mm. The toothbrush can increase brushing efficiency and effectively remove foreign matters between teeth and inside periodontal pockets.

2 Claims, 2 Drawing Sheets

TOOTHBRUSH HAVING SOFT AND HARD BRISTLES TOGETHER

RELATED APPLICATIONS

This application claims priority to Korean patent application no. 2002-0066977, filed Oct. 31, 2002, entitled Toothbrush Having Soft and Hard Bristles Together, which is incorporated herein by reference in its entirety.

BACKGROUND OF THE INVENTION

1. Field of the Invention

The present invention relates to a toothbrush with tapered acicular bristles, and more particularly, to a toothbrush with tapered acicular bristles having soft and hard bristles together.

2. Background of the Related Art

In general, a toothbrush having bristles tapered at pointed ends to increase removal efficiency of the tartar and the plaque from the teeth and to prevent an injury to the gums during brushing teeth has been invented, and since then, such a toothbrush has become more popular due to demonstration of its effectiveness.

Prior art relating to a toothbrush as described above is known. See for example; Korean Patent Nos. 130932, 261658 and 311360, and Korean Utility Model Registration Nos. 114700 and 244827 invented by the present inventor.

Korean Patent No. 130932 discloses a method of making the diameter of the end portions of PBT bristles into about 0.1–0.03 mm by tapering the PBT toothbrush bristles having a diameter of 0.15–0.2 mm to a length of 4–8 mm from the pointed ends of the bristles after decomposing them with chemicals. The toothbrush having the bristles manufactured by the above method has several advantages in that it is less likely to injure the gums, can remove pollutants and bacteria stained on the user's teeth because the bristles can be inserted into the periodontal pockets of the gums, and can easily remove foreign matters because it can be easily inserted between teeth. However, some consumers are unsatisfied with the toothbrush as they do not experience good brushing feeling due to the excessively soft bristles.

Korean Utility Model Registration No. 114700 discloses a toothbrush having different tapered lengths by tapering the end quarter of a bristle (the tapered length is about 8 mm in case of the bristle length of 32 mm) at one side of the brush and by tapering the end ⅛th (the tapered length is about 4 mm in case of the bristle length of 32 mm) at the other side. The toothbrush manufactured by the above method has more overall hardness than that of Korean Patent No. 130932 yet achieves the same tartar and plaque removal effectiveness as that of the Korean patent.

Korean Patent No. 261658 discloses a method for tapering the diameter of the end portions of the PBT bristles from 0.04–0.08 mm using the same method as that of Korean patent No. 130932, wherein physical and chemical methods are combined to save manufacturing costs. People accustomed to nylon bristles, which are rigid, have a preference for the toothbrush manufactured by the above patent, but it has a disadvantage that it is less effective for removing foreign matters inside the periodontal pockets as its diameter is relatively large.

Korean Utility Model Registration No. 244827 discloses a toothbrush including tapered bristles which are formed of 0.02–0.03 mm in diameter at the ends to be easily inserted into periodontal pockets and are formed to be about 3.5 mm or less in length to provide hardness to the bristles. The toothbrush manufactured by the above method provides consumers with a relatively satisfactory result in hardness, tartar removing effect and insertion of the tapered bristle ends into the periodontal pockets.

Korean Patent No. 311360 discloses a toothbrush having on both sides tapered bristles of a general height to be more easily inserted between teeth and into periodontal pockets. The toothbrush has at least one protrusion 1–10 mm in height to serve as an interdental toothbrush.

Such toothbrushes of the prior arts have been all manufactured and sold as separate products, but toothbrushes having all the above advantages of the prior arts have not yet been disclosed.

SUMMARY OF THE INVENTION

Accordingly, the present invention has been made in view of the above problems.

An object of the present invention is to provide a toothbrush comprising bristles which have softness and hardness together and can be easily inserted into periodontal pockets.

Another object of the present invention is to provide a toothbrush with soft and hard bristles together, which can show various functions and be manufactured easily.

To achieve these objects, according to an aspect of the present invention, there is provided a toothbrush having soft and hard bristles with 6–10 mm in tapered length and 0.01–0.08 mm diameter end portions, wherein the ends of the bristles form a semicircular profile in a side view.

BRIEF DESCRIPTION OF THE DRAWINGS

The above and other objects, features and advantages of the present invention will be apparent from the following detailed description of the preferred embodiments in conjunction with the accompanying drawings, in which.

DETAILED DESCRIPTION OF THE PREFERRED EMBODIMENT

Reference will now be made in detail to the preferred embodiments of the present invention, examples of which are illustrated in the accompanying drawings.

Figure 1:
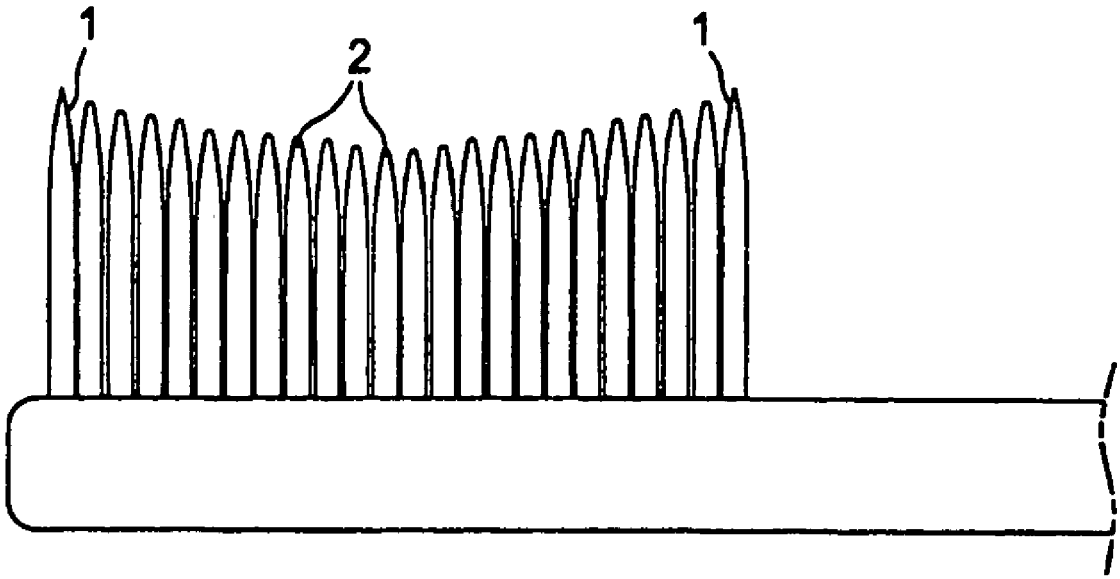
FIG. 1 is a side enlarged view of a toothbrush according to a preferred embodiment of the present invention.

FIG. 1 is a side enlarged view of a toothbrush according to the present invention.

Longer bristles 1 located at both edges of the toothbrush are 25–32 mm in the whole length, which is similar to conventional bristles. Longer bristles 1 have 6–10 mm in tapered length, and are 0.01–0.08 mm in diameter. The longer bristles 1 have relative softness and can be inserted into periodontal pockets well. If the tapered length is less than 6–10 mm, the longer bristles 1 exhibit excessive hardness, which provides consumers with stiffness. On the other hand, if the tapered length exceeds the above range, the longer bristles 1 become so soft that bristle lifespan is reduced. If the longer bristles 1 diameter is less than 0.01–0.08 mm, the longer bristles 1 lack abrasion resistance. If, on the other hand, the diameter exceeds the above range, the longer bristles 1 exhibit excessive hardness, which injures the consumer's gums.

The bristles are increasingly more reduced in length from the edges to the center, and shorter central bristles 2 are the shortest in whole length and tapered length because they are cut the most. Thus, the shorter central bristles 2 have relative hardness. The shorter central bristles 2 have a tapered length of 3–4 mm and are 0.01–0.08 mm in diameter. If the tapered length of the shorter central bristles 2 is less than 3–4 mm, the shorter control bristles 2 have excessive hardness. On the other hand, if the tapered length of the shorter central bristles 2 exceeds this range, the abrasive force of the bristles is reduced due to the lack of hardness.

A difference in length between the longer bristles 1 of the edge sides and the shorter central bristles 2 of the central portion is about 2–4 mm, and more preferably, 2–2.5 mm. If the length difference is less than 2–4 mm, the bristles lack abrasion force as they are too soft, and if the length difference exceeds this range, the bristles injure the consumer's gums during brushing.

Figure 2:
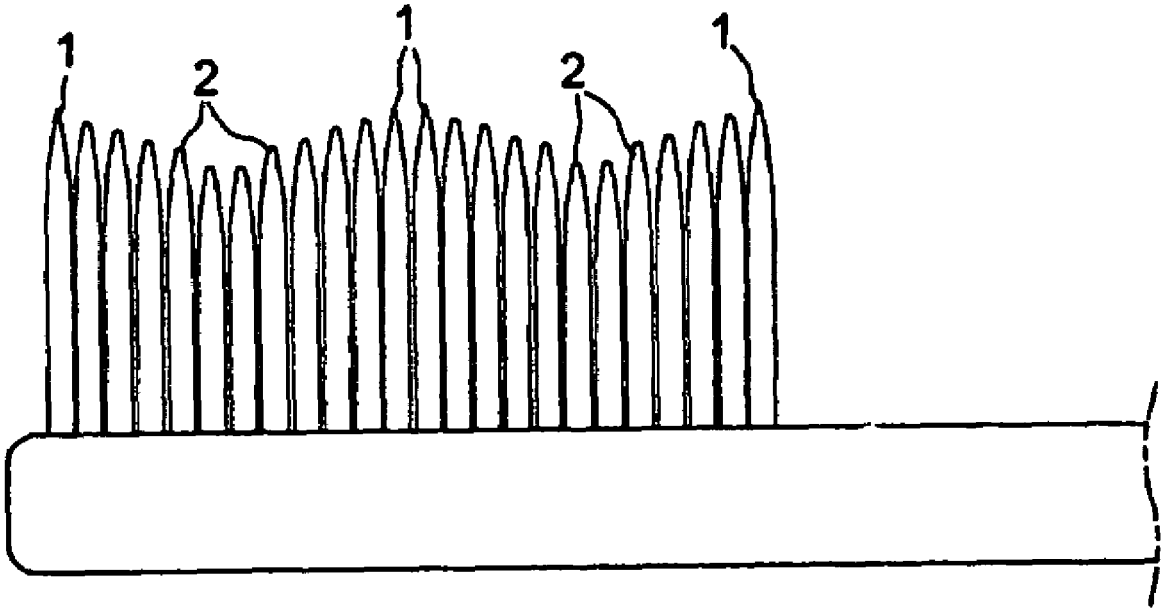
FIG. 2 is a side enlarged view of a toothbrush according to another preferred embodiment of the present invention.

FIG. 2 is a side enlarged view of the toothbrush according to another embodiment of the present invention. In FIG. 2, the bristles are cut to form two semicircles in profile view. In the toothbrush having the above bristles, the bristles located at both edges and the central portion are provided with proper softness to be inserted into periodontal pockets well, and the bristles located between the central portion and the both edges are provided with proper hardness and have good abrasion force or rinsing force for the surface of the teeth.

Furthermore, because the bristles cut in a semicircular form have a curvature similar to that of the teeth, they have a wider contact area between the bristles and the teeth during brushing than that of conventional toothbrushes, thereby increasing a brushing effect. It gives the same effect as the conventional toothbrushes having semicircular bristles.

The cutting and processing methods of manufacturing the toothbrush as described above are as follows. First, the ends of the embedded bristles are cut in a semicircular form with a cutter, and then, the pointed ends of the bristles are ground to be tapered by sand paper. At this time, the bristles are ground to have the tapered length and diameter as described above.

As described above, the toothbrush has proper hardness and softness together. Moreover, since the bristles located at both edges have both longer bristles in overall length and longer tapered length portions, therefore these bristles can be easily inserted between the teeth and into the periodontal pockets. Thus, it is possible to effectively remove foreign matters stained on the teeth. The bristles located at central portion have both shorter bristles in overall length and shorter tapered length portions, therefore these bristles have excellent surface abrasion force and rinsing force as they have the proper hardness. Additionally, the semicircular surface can increase brushing efficiency as it has a curvature similar to that of the teeth.

Furthermore, because the toothbrush can be simply processed by a semicircular cutter, it can be easily manufactured as compared with conventional toothbrushes having longer bristles. As a result, the toothbrush according to the present invention can improve work efficiency.

While the present invention has been described with reference to the particular illustrative embodiment, it is not to be restricted by the embodiment but only by the appended claims. It is to be appreciated that those skilled in the art can change or modify the embodiments without departing from the scope and spirit of the present invention.

What is claimed is:

1. A toothbrush having longer and shorter bristles with 0.01–0.08 mm diameter end portions, the toothbrush comprising:

longer bristles located at both edges, with the longer bristles having a 6–10 mm tapered length; and shorter bristles located at the central portion, with the shorter bristles having a 3–4 mm tapered length; and wherein the ends of the bristles generally form a semicircular profile in a side view, and a difference in length between the longer bristles and the shorter bristles is 2–4 mm.

2. The toothbrush according to claim 1, wherein a difference in length between the longer bristles and the shorter bristles is 2–2.5 mm.

* * * * *